United States Patent [19]

Deal, III

[11] 4,194,993

[45] Mar. 25, 1980

[54] METHOD OF MANUFACTURING POWDERED CLEANING COMPOSITION

[75] Inventor: James F. Deal, III, Spartanburg, S.C.

[73] Assignee: Milliken Research Corporation, Spartanburg, S.C.

[21] Appl. No.: 885,559

[22] Filed: Mar. 13, 1978

[51] Int. Cl.[2] ..... C11D 7/32; C11D 17/06

[52] U.S. Cl. ..... 252/541; 252/88; 252/DIG. 2

[58] Field of Search ..... 252/88, 91, 541, 544, 252/DIG. 2; 260/69 R

[56] References Cited

U.S. PATENT DOCUMENTS

| | | | |
|---|---|---|---|
| 2,766,283 | 6/1955 | Darden | 260/553 |
| 4,013,594 | 3/1977 | Froehlich et al. | 252/544 |
| 4,108,800 | 8/1978 | Froehlich et al. | 252/541 |

FOREIGN PATENT DOCUMENTS

| | | |
|---|---|---|
| 2511854 | 9/1975 | Fed. Rep. of Germany . |
| 2240287 | 4/1975 | France . |
| 39-13484 | 7/1964 | Japan . |

*Primary Examiner*—P. E. Willis, Jr.
*Attorney, Agent, or Firm*—H. William Petry; Terry T. Moyer

[57] ABSTRACT

A method of forming a powdered cleaning composition is disclosed. The process comprises the steps of: polymerizing urea and formaldehyde in acidic aqueous solution to form particles of a specified size and porosity, centrifuging the polymer particles to lower their moisture content to less than about 43%, blending polyethylene oxide into the polymer, spraying a fine mist of detergent solution directly onto the polymer mass as it is being blended. The acid may be neutralized by adding buffer to the solution after the urea and formaldehyde are polymerized or by spraying a mist of buffer containing solution directly onto the polymer as it is being blended.

2 Claims, No Drawings

METHOD OF MANUFACTURING POWDERED CLEANING COMPOSITION

Powdered cleaning compositions are threatening to revolutionize the carpet maintenance industry. They are quick, effective and can even be used to clean carpets in areas which are in use.

Powdered urea-formaldehyde cleaning compositions which have proved especially advantageous in cleaning carpets are disclosed in U.S. Pat. No. 4,013,594 and application No. 755,751, now U.S. Pat. No. 4,108,800. This invention relates to an improved method of preparing the compositions described in the patent and in the application which minimizes the dusting problems experienced with the method of preparation described in the patent. This method further produces an improved product since it results in a smaller fraction of extremely fine particles which are normally somewhat difficult to remove from the carpet after vacuuming. As a further benefit, the method of the present advantage is significantly less expensive than the prior art method.

SUMMARY OF THE INVENTION

The method of the present invention comprises the following steps: urea and formaldehyde are polymerized as described in U.S. Pat. No. 4,013,594; the slurry is neutralized and thereafter centrifuged to lower the water content to from about 32% to about 40%; about 0.2% to about 1.0% by weight of polyethylene oxide powder having a molecular weight of at least about 20,000 is sprinkled onto the urea-formaldehyde as it is being blended, water containing a sufficient amount of a buffer to neutralize residual acid in the polymer is sprayed onto the urea-formaldehyde as it is being blended; detergent, anti-static agent and any other desired additives are sprayed onto the urea-formaldehyde as it is being blended; and the product is blended still further to assure a uniform mix.

DESCRIPTION OF THE INVENTION

Methods of polymerizing urea and formaldehyde are well known. However, when a carpet cleaning composition is being formed, it is critical that the particle size be maintained within close limits. Particles smaller than about 10 microns tend to be difficult to retrieve from the carpet after cleaning while particles larger than about 105 microns are difficult to force into the pile of the carpet. As described in U.S. application No. 755,751, when polyethylene oxide having a molecular weight of above about 20,000 is added to powdered urea-formaldehyde cleaning compositions, it is easier to retrieve the fine particles of polymer from the carpet after cleaning. However, if any liquid or polyethylene oxide is added directly to wet polymer slurry, lumps are formed and the particles become too large to provide optimum efficiency in cleaning. To further complicate the problem, the particles must be extremely porous if they are to provide the desired cleaning efficiency. As indicated in U.S. Pat. No. 4,013,594, the oil value of the urea-formaldehyde should be at least about 90. For the purposes of this invention, a particularly convenient method of forming urea-formaldehyde particles of the desired size and porosity is the modification described in U.S. Pat. No. 4,013,594 of the method described in U.S. Pat. No. 2,766,283. In summary, urea and formaldehyde in mole ratio of about 0.91 moles of urea to about 1.0 moles of formaldehyde are polymerized in dilute aqueous solution (mole ratio water/formaldehyde about 12.5 to 1.0) at a pH of about 1.8, at a temperature of about 37° C.

At some time it is necessary to neutralize the acid in the water. This may be done either after the reaction is complete by adding buffer to the solution before the polymer is centrifuged or by spraying a fine mist of buffer in aqueous solution onto the polymer after it has been centrifuged. In any event, after the reaction is complete, the polymer slurry is centrifuged to a moisture content of about 32% to 40%. In the formulation method described in U.S. Pat. No. 4,013,594, the polymer slurry is dried in a vacuum oven rather than being centrifuged. This procedure has the dual disadvantages of requiring more energy and of producing more fine particles than the method of the present invention. This prior art method produces more fine particles since urea-formaldehyde is somewhat friable and large particles are easily broken down during handling especially when they are dry.

In the method used in the prior art, large quantities of urea-formaldehyde dust were formed after coating the entire preparation area with a fine layer of dust. Of course, whenever such large quantities of a flammable dust are formed, there is at least a theoretical danger of an explosion. Since the method of the present invention does not require handling of dry polymer, fewer fine particles are formed and the concurrent environmental safety and housekeeping problems of dusting are eliminated. However, to obtain these benefits, it is necessary to reduce the moisture content of the polymer slurry to less than 43% and preferably to between about 32% and about 40% or the polymer slurry will agglomerate when either liquid or polyethylene oxide is added. Even when the polymer is centrifuged to the proper moisture content, the manner in which the polyethylene oxide and other ingredients are added is extremely critical. If they are added improperly, the urea-formaldehyde will agglomerate.

The polyethylene oxide is added by slowly sprinkling it onto freshly blended surfaces of urea-formaldehyde polymer. While the polyethylene oxide should be in the form of a powder, the exact particle size is not critical. Particles under about 2000 microns are suitable although particles of about 500 microns or less are preferred.

After centrifugation, polyethylene oxide in an amount equal to about 0.2% to about 1.0% of the weight of the filtrate is added to the polymer mass and the product is blended. It is extremely critical that the moisture content of the polymer be reduced to no more than 43% and preferably to no more than about 40% before either liquid or polyethylene oxide is added or undesirable agglomeration of the polymer particles will result which will greatly lessen the cleaning efficiency of the cleaning composition if a usable product is obtained at all.

After the polyethylene oxide has been added, then water may be added to increase the water content of the cleaning composition to about 41%. Advantageously, the water added will contain a buffer to neutralize residual acid trapped in the polymer particles as a result of the polymerization process. Any buffer which does not interfere with the cleaning composition may be used. Preferred buffers include disodium phosphate, sodium carbonate, potassium phosphate, trisodium phosphate and similar bases. The manner in which the water is added is critical, if the water is merely added to the polymer then lumps form and the product is unusable.

However, if the water is slowly sprayed in the form of a fine mist as the polymer is being agitated or blended then the water mixes without degrading the product. It is critical that the product be blended while the spray is introduced and the water must be introduced in the form of a spray or mist rather than in a continuous stream. One nozzle which forms a sufficiently fine mist or spray is the Uni-Jet ¼-TTD 6-23.

While most commercial blenders are satisfactory, it is essential that the nozzle be placed so that spray can be directed on to a well mixed powder surface without impinging on the walls, lid, mixing blade or any other surface where large drops can form. Large drops or wet surfaces must be avoided as the powder tends to form lumps when it contacts either. It is most advantageous to use a ribbon blender with vertically extended side walls so that powder can be placed into the blender to sufficient depth to completely cover the mixing blades.

After the water content of the polymer has been brought to the desired level, the detergent, anti-static agents and any other desired additives such as optical brighteners and odorants may be added by spraying as the composition is being blended.

EXAMPLE I 450 pounds of urea-formaldehyde polymer which was produced according to the procedure set forth above and dried to 15% moisture content was reslurried with 1200 pounds of potable water in a 3000 gallon glass lined vessel equipped with a 15 hp motor powering a standard Pfaudler agitator. The mixture was stirred for several hours to insure complete uniformity of mixing and then heated to 55° C. The mixture was introduced into a centrifuge which is capable of producing a force which is 800 times the force of gravity. The mixture was dewatered at maximum speed for 30 minutes and then placed into lined steel drums. The moisture content was 32.7% as measured by the weight differential. 25 lbs. of the wet urea-formaldehyde was charged into the bowl of a Hobart mixer equipped with a 1.5 hp motor turning a perforated paddle agitator at 40 rpm. 68 grams of polyethylene oxide having a molecular weight of about 900,000 was added over a 30 minute period. After 30 additional minutes of blending, a solution of 44 grams of disodium phosphate in 2.22 lbs. of water was slowly sprayed over the mixture as it was blended. After 30 more minutes of blending, the following detergent solution was sprayed over the mixture as it was being blended:

705.2 grams Arguad 18-50 (50% octodecyltrimethyl ammonium);
352.6 grams Triton X-45 (t-octyl phenol - 5 moles ethylene oxide);
12.45 grams Calcofluor White RW (optical Brightener); and
1.74 grams Lemon Reodorant After thirty additional minutes of blending, the powder recovered was fluffy, but contained many small hard lumps approximately 2–3 mm in diameter. It is thought that these lumps were due to agglomeration occurring about droplets of the detergent. The lumps were eliminated by grinding through a fine mesh screen. The moisture content of the powder was increased to 37% by a further over spray of water as the powder was being blended.

EXAMPLE II 12,670 pounds of potable water was introduced into a 3000 gallon glass-lined Pfaudler reactor having an agitator rotating at 45 rpm. 4260 pounds of urea was dissolved in the water and the reactor was heated to bring the temperature of the mixture up to 33° C. After the urea was completely dissolved 6040 pounds of 37% formaldehyde at 49° C. was introduced into the reactor, then 420 pounds of 20% sulfuric acid was introduced through a spray nozzle. Upon addition of the acid, cooling was started to stabilize the temperature at around 50° C. to 60° C. After 2.0 hours the reactor was cooled to 50° C. and 160 pounds of 50% sodium hydroxide was added to adjust the pH to 7.0–7.5. 76 pounds of disodium phosphate were dissolved in the slurry which was centrifuged down to 39% moisture. 1125 pounds of the resulting polymer was placed in a ribbon blender. Six pounds of polyethylene oxide having a molecular weight of 900,000 was added as the mixture was being blended. After 20 minutes, 68.5 pounds of detergent solution was added through 4 SprayCo ¼ TTD5-35 spray nozzles. The composition of the detergent was:

65.78% Arquad 18-50
32.89% Triton X-45
1.17% Calcofluor White RW
0.16% Lemon Reodorant The resulting cleaning composition was suitable for shipping.

As my invention, I claim:

1. A method of preparing a powdered cleaning composition comprising the steps of:

polymerizing urea and formaldehyde in aqueous acidic solution to form a mass of polymer particles having an average particle size between about 10 and 105 microns and an oil value of at least about 90;

neutralizing the mass of polymer particles;

centrifuging the mass of polymer particles until the moisture content of said mass of polymer particles is less than about 43, but more than 30% based on the dry weight of the polymer;

sprinkling at least about 0.2% of polyethylene oxide powder having a molecular weight of at least about 20,000 onto freshly blended surfaces of the polymer mass as it is being blended; and spraying sufficient surfactant into the polymer mass to lower the surface tension of the moisture therein to no more than about 40 dynes per centimeter.

2. A method of preparing a powdered cleaning composition comprising the steps of:

polymerizing urea and formaldehyde in aqueous acidic solution to form a mass of polymer particles having an average particle size between about 10 and 105 microns and an oil value of at least about 90;

centrifuging the mass of polymer particles until the moisture content of said mass of polymer particles is less than about 43 but more than 30% based on the dry weight of the polymer;

sprinkling at least about 0.2% of polyethylene oxide powder having a molecular weight of at least about 20,000 onto freshly blended surfaces of the polymer mass as it is being blended;

spraying a solution of a buffer in water in the form of a mist directly onto the polymer mass and simultaneously blending the polymer mass to continually expose new surface to the spray, the amount of solution being sufficient to maintain the moisture content of the mass of polymer particles to between about 30% and about 43% and the amount of buffer being sufficient to substantially neutralize the residual acid in the mass of polymer particles; and spraying sufficient surfactant directly onto the polymer mass to lower the surface tension of the moisture therein to no more than about 40 dynes per centimeter.

* * * * *